US011001465B2

(12) United States Patent
Obererlacher et al.

(10) Patent No.: US 11,001,465 B2
(45) Date of Patent: May 11, 2021

(54) DEVICE FOR THE LINEAR CORRECTIVE TRANSPORT OF RIBBON-SHAPED SUBSTRATES

(71) Applicant: Durst Phototechnik Digital Technology GmbH, Lienz (AT)

(72) Inventors: Jakob Obererlacher, Lienz (AT); Reinhard Schneeberger, Irschen (AT); Peter Weingartner, Lienz (AT)

(73) Assignee: DURST PHOTOTECHNIK DIGITAL TECHNOLOGY GMBH, Lienz (AT)

( * ) Notice: Subject to any disclaimer, the term of this patent is extended or adjusted under 35 U.S.C. 154(b) by 42 days.

(21) Appl. No.: 16/080,095

(22) PCT Filed: Feb. 20, 2017

(86) PCT No.: PCT/EP2017/000217
§ 371 (c)(1),
(2) Date: Aug. 27, 2018

(87) PCT Pub. No.: WO2017/153035
PCT Pub. Date: Sep. 14, 2017

(65) Prior Publication Data

US 2019/0055100 A1 Feb. 21, 2019

(30) Foreign Application Priority Data

Mar. 6, 2016 (DE) ..... 10 2016 002 601.4

(51) Int. Cl.
*B65H 9/00* (2006.01)
*B65H 7/14* (2006.01)

(52) U.S. Cl.
CPC ..... *B65H 9/002* (2013.01); *B65H 7/14* (2013.01); *B65H 2404/1424* (2013.01);
(Continued)

(58) Field of Classification Search
CPC ..... B65H 9/002; B65H 9/10; B65H 9/106
(Continued)

(56) References Cited

U.S. PATENT DOCUMENTS 6,168,153 B1 * 1/2001 Richards ..... B65H 5/062 271/226
8,047,537 B2 * 11/2011 deJong ..... B65H 7/06 271/228

(Continued)

FOREIGN PATENT DOCUMENTS

DE 10214531 A1 10/2002
DE 10214534 A1 7/2005

(Continued)

OTHER PUBLICATIONS

European Patent Office,Rijswijk, Netherlands, International Search Report of International Application No. PCT/EP2017/000217, dated Jul. 24, 2017, 3 pages.

*Primary Examiner* — Thomas A Morrison
(74) *Attorney, Agent, or Firm* — Brinks Gilson & Lione; John C. Freeman

(57) ABSTRACT

A device having a receiving device for receiving at least one ribbon-shaped substrate and with a first and a second driving means, wherein the first and the second driving means for the transport of the ribbon-shaped substrate in x-direction are designed to cooperate such that the first driving means engages in the region of the one edge of the ribbon-shaped substrate and the second driving means engages in the region of the other edge of the ribbon-shaped substrate, wherein both driving means can be controlled such that they can drive the edge area of the ribbon-shaped substrate assigned to each driving means at adjustably different drive speeds. At least the first driving means is arranged in the device via a first displacement device allowing for a dis-
(Continued)

placement essentially limited to the y-direction of the first driving means, relative to the receiving device.

9 Claims, 4 Drawing Sheets

(52) U.S. Cl.
CPC ..... *B65H 2511/12* (2013.01); *B65H 2511/20* (2013.01); *B65H 2553/416* (2013.01)

(58) Field of Classification Search
USPC ..... 271/226–228
See application file for complete search history.

(56) References Cited

U.S. PATENT DOCUMENTS

| | | | | |
|---|---|---|---|---|
| 8,746,692 | B2 * | 6/2014 | Richards | B65H 9/002 271/228 |
| 2009/0033029 | A1 | 2/2009 | Kinoshita et al. | |
| 2010/0207322 | A1 * | 8/2010 | Yasumoto | B65H 9/002 271/228 |
| 2010/0276877 | A1 | 11/2010 | Richards et al. | |

FOREIGN PATENT DOCUMENTS

| | | | |
|---|---|---|---|
| JP | H11301890 | A | 11/1999 |
| JP | 2007186291 | A | 7/2007 |
| WO | 2010034540 | A1 | 4/2010 |

* cited by examiner

DEVICE FOR THE LINEAR CORRECTIVE TRANSPORT OF RIBBON-SHAPED SUBSTRATES

CROSS REFERENCE TO RELATED APPLICATIONS

This application claims priority to PCT/EP2017/000217 filed on Feb. 20, 2017 and DE 102016002601.4 filed on Mar. 6, 2016, the entire contents of each herein incorporated in their entirety by reference.

FIELD

The present disclosure relates to a device for the scalable alignment in width of sheet-shaped and/or plate-shaped substrates, each having a predetermined width during transport. Due to the predetermined width a corresponding substrate is also referred to as a ribbon-shaped substrate.

BACKGROUND

The statements in this section merely provide background information related to the present disclosure and several definitions for terms used in the present disclosure and may not constitute prior art.

Today various printing presses print different ribbon-shaped substrates, such as paper sheets, wooden planks, ceramic tiles, laminate and/or plastic plates. In any case, the ribbon-shaped substrate to be printed must be transported on a transport path to the printer, with the correct orientation and position being of great importance during printing. This is especially true, if the ribbon-shaped substrate has several printing passes to go through, as is, for example, sometimes the case for multicolour printing. But also other process steps such as cutting or punching require a precise positioning of the ribbon-shaped substrate to be treated.

Due to its sheet-shaped and/or plate-shaped form a corresponding ribbon-shaped substrate has essentially two parallel sides. Here it is necessary to define in advance several terms used in the present disclosure. The side on which the ribbon-shaped substrate rests will be referred to for the purpose of the present disclosure as rear side, the other side as front side. In many applications, these ribbon-shaped substrates such as paper sheets to be printed or tiles to be printed must be fed to a device treating the surface of the front side of the ribbon-shaped substrate, wherein the correct orientation and position of the ribbon-shaped substrate must be ensured for a corresponding transport.

In this respect, orientation is understood for the purpose of the present disclosure to mean the angular alignment of the ribbon-shaped substrate and position is understood to mean its position in the three-dimensional space. In the frame of the present disclosure it is essentially about the linear transport of the ribbon-shaped substrate in one direction parallel to the sides of the substrate and perpendicular to the predetermined width. In the following this direction will be referred to as x-direction. The direction that is defined by the normal to the front side of the ribbon-shaped substrate will be referred to in the present disclosure as z-direction in the following. The direction that is orthogonal both to the x-direction and the z-direction and by which direction constituting the ordinate and the x-direction constituting the abscess a right-handed system is defined will be referred to as y-direction in the following. During the linear transport the ribbon-shaped substrate is guided over a support. For the purpose of the present disclosure the origin of a Cartesian right-handed coordinate system will be determined at this support, with the x-axis showing into x-direction, the y-axis into y-direction and the z-axis into z-direction.

As a rule, the angular alignment of the normal of the front side of the ribbon-shaped substrate relative to the support (in the following z-orientation) is automatically given and thus correct. The same applies for the position in z-direction. The orientation of the substrate in the x-y-plane (in the following disclosure is referred to as x-y-orientation), however, is only correct, if during transport the positions in which the edges of the substrate intersect the y-z-plane spanned by the y-axis and z-axis stay always the same. This x-y-orientation must mostly be monitored and, if necessary, be corrected. And even if the x-y-orientation is correct, it must be ensured that the correct y-position is taken and kept, i.e. the edges of the ribbon-shaped substrate should intersect the y-z-plane at the desired positions.

For the purpose of this disclosure, the corrective transport or corrective transportation will be referred to as a linear transport of a ribbon-shaped substrate along an x-direction, wherein during transport the positions in which the edges of the substrate intersect the y-z-plane spanned by the y-axis and z-axis are the desired positions (correct y-position) and should always stay the same. Thus, in case of deviations, the x-y-orientation and, if necessary, the y-position will be corrected.

In DE 10214531A1 such correction has been achieved, namely, on the one hand, the correction of the y-position by means of a pulling mechanism and, on the other hand, the correction of the x-y-orientation by means of the speed difference of two conveyor belts for transporting the paper sheets. Correspondingly, a feed table is shown with a pulling mechanism and two endless conveyor belts arranged thereon. The conveyor belts are driven each by separately controllable drives so that the paper sheet can be displaced at different driving speeds of the drives. The feed table particularly comprises one sensor per conveyor belt, which sensor allows detecting the position of the sheet.

The feed table in accordance with DE 10214534 A1, however, is only designed for one width of the paper sheets. It is, for example, not possible to transport correctively ribbon-shaped substrates whose width is smaller than the distance of the conveyor belts. The same applies to ribbon-shaped substrates whose width exceeds the distance of the conveyor belts by factors. In this case, too, a corresponding corrective transport is not possible without problems, since due to the relative small distance of the conveyor belts compared to the extension of the ribbon-shaped substrate the force to be transferred from the conveyor belts to the ribbon-shaped substrate for achieving a correction of the orientation of the much more extended ribbon-shaped substrate is relatively great. In case of large force transmissions it is additionally necessary to control the speed differences more accurately, since even small differences can lead to major corrections at the edge of the ribbon-shaped substrate.

Therefore, there is a need for a device that allows transporting correctively ribbon-shaped substrates with completely different widths.

SUMMARY

The present disclosure generally addresses the problem by providing a device that allows transporting correctively ribbon-shaped substrates with completely different widths.

According to one aspect of the present disclosure this problem is solved by a device for the linear corrective transport of ribbon-shaped substrates having a receiving device for receiving at least one ribbon-shaped substrate and with a first driving means and a second driving means, wherein the first and the second driving means for the transport of the ribbon-shaped substrate in x-direction are designed to cooperate in such manner that the first driving means can become effective by engaging in the region of the one edge of the ribbon-shaped substrate and the second driving means can become effective by engaging in the region of the other edge of the ribbon-shaped substrate, wherein both driving means can be controlled in such a way that they can drive the edge area of the ribbon-shaped substrate assigned to each driving means at adjustably different speeds, characterized in that at least the first driving means is arranged in the device via a first displacement device allowing for a displacement essentially limited to the y-direction of the first driving means, relative to the receiving device.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present disclosure will now be described by way of example in detail and on the basis of the figures. The drawings described herein are for illustration purposes only and are not intended to limit the scope of the present disclosure in any way.

DETAILED DESCRIPTION

Figure 1A:
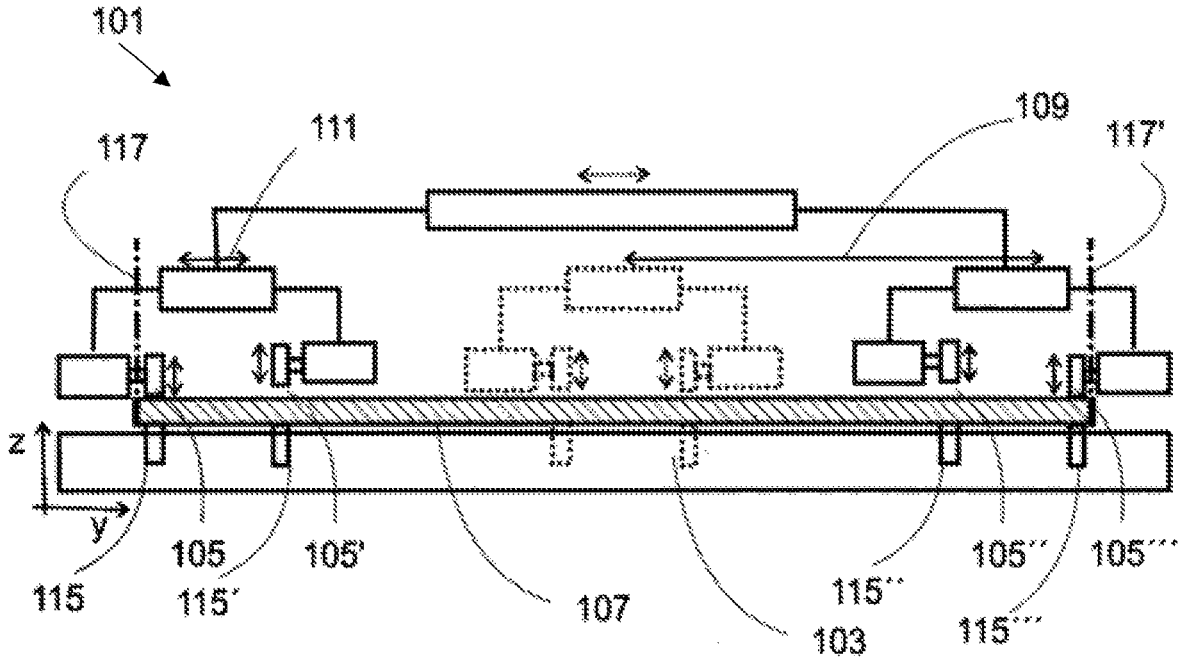
FIG. 1*a* shows a device according to the teachings of the present disclosure loaded with a large format ribbon-shaped substrate.

The following description is merely exemplary in nature and is in no way intended to limit the present disclosure or its application or uses. It should be understood that throughout the description, corresponding reference numerals indicate like or corresponding parts and features.

The device of the present disclosure is based on the idea to design those means which are used to correct the x-y-orientation in such a way that their effective width can be adjusted over a large range. Thus, a device loaded with a ribbon-shaped substrate according to the present disclosure has in the region of the one edge of the ribbon-shaped substrate a first driving means for feeding the ribbon-shaped substrate in the x-direction and it has at the other edge of the ribbon-shaped substrate a second driving means for feeding the ribbon-shaped substrate in x-direction, the second driving means cooperating with the first driving means; wherein at least one of the driving means is arranged in the device in such a way that a displacement limited to the y-direction is possible so that, by displacing the at least one driving means in y-direction, the effective width of both cooperating driving means can be adjusted to the width of the ribbon-shaped substrate and wherein the first and the second driving means can be driven at adjustably different drive speeds so that a correction of the x-y-orientation of the ribbon-shaped substrate can be made.

Correspondingly, the device according to the present disclosure is a device for the linear corrective transport of ribbon-shaped substrates having a receiving device for receiving at least one ribbon-shaped substrate and having a first driving means and a second driving means, wherein the first and the second driving means for the transport of the ribbon-shaped substrate in x-direction are designed to cooperate in such manner that the first driving means can become effective by engaging in the region of the one edge of the ribbon-shaped substrate and the second driving means can become effective by engaging in the region of the other edge of the ribbon-shaped substrate, wherein both driving means can be controlled in such manner that they can drive the edge area of the ribbon-shaped substrate assigned to each driving means at adjustably different drive speeds. The device according to the present disclosure is characterized in that at least the first driving means is arranged in the device via a first displacement device allowing for a displacement essentially limited to the y-direction of the first driving means, relative to the receiving device.

According to another aspect of the present disclosure the first driving means and the second driving means are arranged in the first and/or a second displacement device in such manner that they form a first drive pair, which can be displaced in the y-direction while maintaining the distance of the two driving means, in particular also during the feeding of the ribbon-shaped substrate in the x-direction.

The first displacement device can particularly be designed in such a way that the distance between the first driving means and the second driving means with respect to the y-direction can eligibly be adjusted.

According to a further aspect of the present disclosure, the device comprises four driving means, each of them can be controlled in such manner that they can drive each adjustably at different speeds ribbon-shaped substrates in x-direction, wherein the four driving means are each individually height-adjustable in z-direction and the four driving means form two drive modules each having two driving means at a fixed distance D from each other, with respect to the y-direction; wherein one of the two drive modules is arranged at the first displacement device so that for large format ribbon-shaped substrates its position can be chosen in such manner that one driving means of the one drive module forms the first driving means and one driving means of the second drive module forms the second driving means, whereas for small format ribbon-shaped substrates one driving means of the drive module at the first displacement device forms the first driving means and the other driving means of the same drive module at the first displacement device forms the second driving means.

The described device having two drive modules can comprise a second displacement device so that respectively one drive module is arranged at respectively one displacement device.

The first and the second displacement device can be designed in such a way that both drive modules can be displaced synchronously in the y-direction while maintaining the distance of the drive modules to each other in y-direction. Thus, an efficient correction of the y-position of the ribbon-shaped substrate can be made.

In this context it may be emphasized that a correction of the y-position of the ribbon-shaped substrate during the x-feed can already be achieved by a clever sequence of speed differences. If, for example, the one driving means in the one edge area of the ribbon-shaped substrate runs more slowly in the short term than the other driving means in the other edge area of the ribbon-shaped substrate, the x-y-orientation of the ribbon-shaped substrate changes. If now the speeds are interchanged, i.e. the driving means in the one edge area of the ribbon-shaped substrate that previously ran more slowly runs faster in the short term than the other driving means in the other edge area of the ribbon-shaped substrate that previously ran faster, one returns to the original x-y-orientation, resulting, however, in a y-misalignment of the y-position of the ribbon-shaped substrate. In this case the possibility of displacing the second driving means could, for example, be dispensed with. As a consequence, the device could be manufactured more cost-effectively. The possibility of displacing the first and the second driving means synchronously may be desirable, however, since it can be carried out more easily and without any x-feed.

Referring to FIG. 1*a* a device 101 according to the present disclosure is shown loaded with a large format ribbon-shaped substrate 107. The device comprises a support 103 on which the large format ribbon-shaped substrate 107 can be placed. Furthermore, the device comprises four driving means 105, 105', 105" and 105'" which are designed in the example as roller drives. The rotation speed of all four driving means can be adjusted individually for each driving means. The z-axis and the y-axis are also marked in the figure. The x-axis would be pushed out of the image plane, i.e. ribbon-shaped substrates are moved out in the direction of the image plane by means of the device.

In the example the roller drives 105" and 105'" have a fixed distance, but they can be displaced together with a first displacement device 109 along the y-direction. Both roller drives 105", 105'" form together a drive module that is arranged at the first displacement device 109. The counterrollers 115" and 115'" arranged at the first displacement device 109 are also part of this device and thus can be displaced synchronously together with the drive module, if required.

Accordingly, the roller drives 105 and 105' have a fixed distance from each other, but they can be displaced together by means of a second displacement device 111 along the y-direction. Both roller drives 105, 105' form together a further drive module which is arranged at the second displacement device 111. The counterrollers 115 and 115' arranged at the second displacement device 111 are also part of this device and thus can be displaced synchronously together with the further drive module, if required.

The first and the second displacement devices 109, 111 can be connected to one another in such manner that both drive modules can be displaced, for example, synchronously, in the same direction, at the same speed and by the same amount along the y-direction.

In the case of a large format substrate, as shown in FIG. 1*a*, only one roller drive of the one drive module and one roller drive of the further drive module are used. FIG. 1*a* shows that the roller drive 105 is put down in the edge area of the ribbon-shaped substrate on said substrate and clamps it together with the counterroller 115 placed below, so to speak. For that purpose the roller drive 105 is adjusted in the z-direction to the thickness of the ribbon-shaped substrate and the contact pressure of the rollers is regulated, for example, by means of a proportional valve. The counterroller 115 can be stowed with separate guide in the support. The counterroller 115 can be driven by means of a spindle that is coupled with the engine of the roller drive 105. The roller drive 105', in contrast, is lifted, i.e. it is driven away from the ribbon-shaped substrate in the z-direction. The roller drive 105', however, could also rest on the ribbon-shaped substrate and run powerlessly together with it.

Accordingly applies to the other drive module: the roller drive 105'" is adjusted to the thickness of the ribbon-shaped substrate and clamps it together with the counterroller 115'" placed below the roller drive. In contrast, the roller drive 105" is driven away from the surface of the ribbon-shaped substrate in z-direction and has no impact on said substrate. It is again possible for a roller drive 105" placed thereon to run powerlessly with it.

As the ribbon-shaped substrate is now clamped at both edges by the roller drives 105 and 105'", the synchronous displacement of both drive modules along the y-direction can lead to a specific change in the position of the ribbon-shaped substrate. Thus the ribbon-shaped substrate can be aligned on the right side, on the left side and on both sides.

As the rotational speed of the roller drives 105 and 105" can be adjusted individually and independently from each other, the x-y-orientation can be changed specifically in a simple way by small speed differences between both roller drives. In this respect the combination of roller drive and counterroller has the particular advantage that they act on the ribbon-shaped substrate not in a two-dimensional manner, but essentially in a punctual or linear manner, resulting in a further simplified change in the x-y-orientation compared to the prior art where this aim has been achieved by means of endless conveyor belts on which the ribbon-shaped substrate is placed in a two-dimensional manner.

In order to measure the position and the orientation of the ribbon-shaped substrate the device can comprise one or more laser measuring systems. In the described example two multi-purpose CCD laser micrometer 117, 117' are mounted in a defined distance in x-direction. These measuring systems measure the angular deviation of the ribbon-shaped substrate and transmit deviations to the roller drives. The roller drives align the substrate at different feeding speeds (roller speeds) as described above and transport the substrate in x-direction. At the same time and thus during the transport in x-direction the position of the ribbon-shaped substrate is determined in y-direction by means of one of the measuring devices 117, 117' and by means of the synchronous displacement of the drive modules the ribbon-shaped substrate is brought into the desired y-position in y-direction.

If, as described above, a laser micrometer is used, the printing substrate must be positioned between the transmitter and the receiver of the laser micrometer and within the measuring range (in this example: 28 mm) by the feeder or by hand, so that said measuring system can measure successfully. For this purpose in a first step of this method the ribbon-shaped substrate will be roughly aligned (for example against reference elements on the front side or lateral reference elements).

Figure 1B:
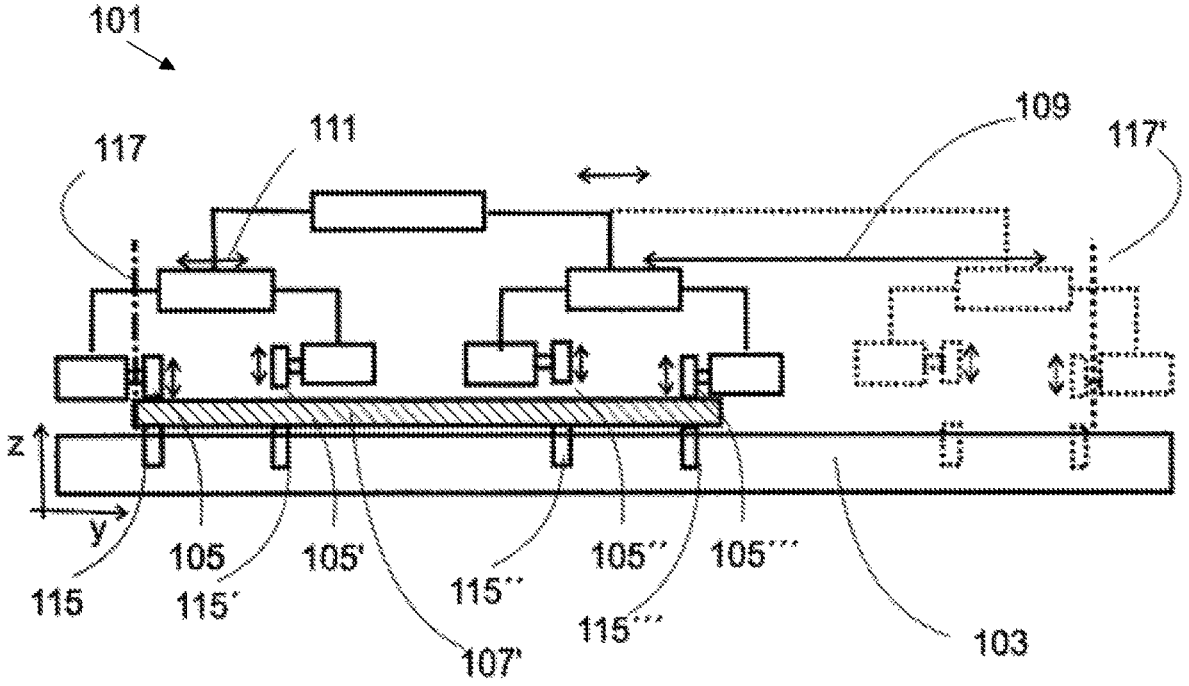
FIG. 1*b* shows a device according to the teachings of the present disclosure loaded with a middle format ribbon-shaped substrate.

Referring now to FIG. 1*b*, the corresponding situation for a middle format ribbon-shaped substrate is shown. In this case, the drive module connected to it has been displaced in y-direction by means of the first displacement device 109 in such manner that the distance between the drive modules is adjusted to the width of the current ribbon-shaped substrate. The original position of the displaced working module is marked in FIG. 1*b* with a dashed line.

Figure 1C:
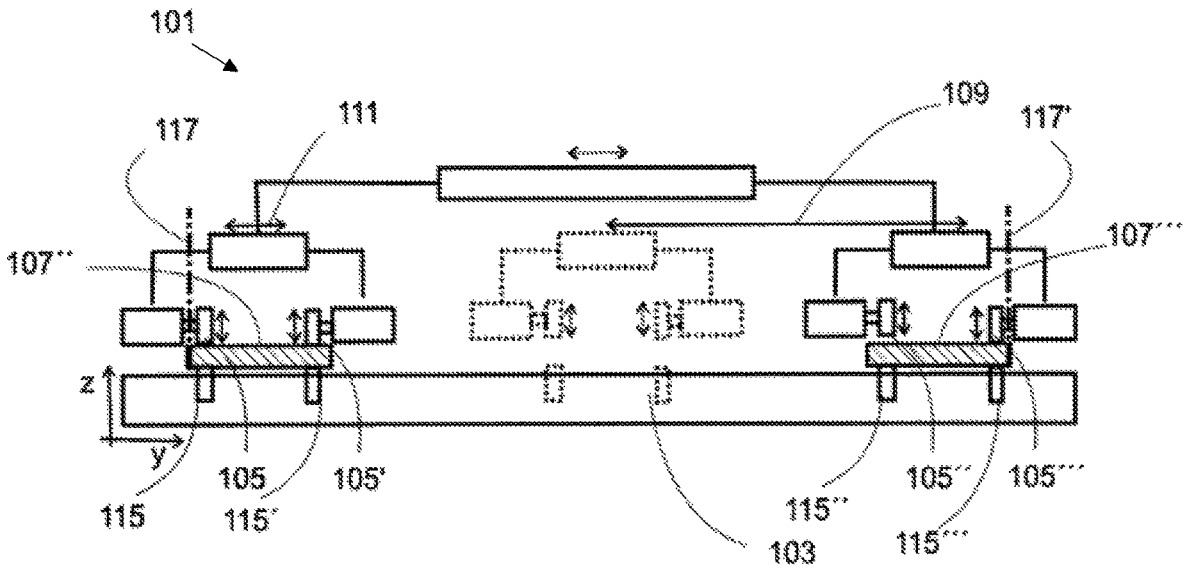
FIG. 1*c* shows a device according to the teachings of the present disclosure loaded with two small format ribbon-shaped substrates.

Referring now to FIG. 1*c*, the situation for the corrective transport of very small ribbon-shaped substrates 107", 107'" is shown. In this case, both roller drives 105 and 105' are responsible for the drive of the small ribbon-shaped substrate 107". The fixed distance D of the roller drives 105 and 105' from each other is adjusted to the ribbon-shaped substrate having the smallest width that may be used. The corresponding drive module can be displaced by means of the second displacement device 111 and both roller drives 105 and 105' can be operated at different speeds. The former aspect allows correcting the y-position, the latter allows influencing correctively the x-y-orientation. The current position and the x-y-orientation of the ribbon-shaped substrate 107" to be transported are measured by the laser measuring system 117 as described above. In this respect it is particularly advantageous that independently from the transport of the small ribbon-shaped substrate 107" by means of the other drive module having the roller drives 105" and 105'" a further small ribbon-shaped substrate 107'" can simultaneously be transported correctively.

The simultaneous transport of two ribbon-shaped substrates 107", 107'" having small widths is the reason why two laser measuring systems 117. 117' are arranged at the device as shown.

Figure 2:
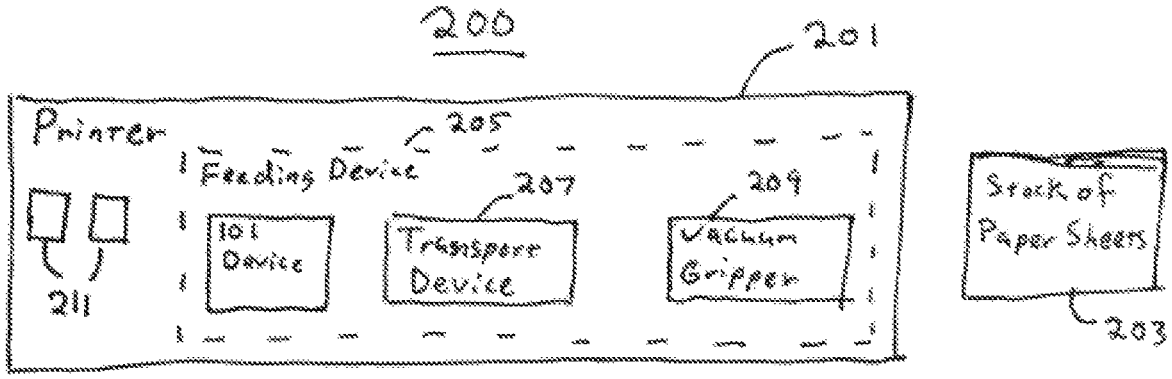
FIG. 2 schematically show an embodiment of a printing system that includes the device of FIGS. 1*a-c*.

For printing paper sheets, a printing system 200 is employed. As shown schematically in FIG. 2, the printing system 200 includes a printer 201 and a stock of paper sheets 203. The stock of paper sheets 203 is approached to a feeding device 205 (schematically represented by dashed lines in FIG. 2), for example, by means of Euro pallet and lift truck and lifted in z-direction to the height of a transport device 207 of the feeding device 205, such as a transport table, of the feeding device. A vacuum gripper 209 of the feeding device 205 is equipped with elastic vacuum suction heads arranged over the width, i.e. in y-direction, grips in the region of the front edge of the top paper sheet said sheet, i.e. the vacuum suction heads suck themselves. Now the vacuum gripper 209 pulls the top paper sheet onto the transport table of the feeding device 205. The transport table is equipped with endless conveyor belts, which push the paper sheet to the device for corrective transport according to the present disclosure, after the paper sheet has been released from the vacuum gripper 209 by switching off the vacuum. There, the paper sheets gets into the effective range of the first driving means of the device 101 at its one edge and of the second driving means at its other edge. At the same time the position of the edge as well as the x-y-orientation are measured by the laser measuring system. A well-adjusted CCD matrix is used as a sensor of the laser measuring system. If there is no paper sheet in the device, the matrix will be completely illuminated, i.e. laser light gets to each pixel. If the edge of a paper sheet gets into the effective range of the CCD matrix, no light will get to places where it is covered by the paper. Thus, there are pixels in the edge area, which receive light next to pixels, and which do not receive any light. In this way, the y-position as well as the x-y-orientation of the paper sheet can be easily determined. The target position and the target orientation of the edge are saved in an evaluation unit so that an actual-target comparison can be carried out. If the y-position is not correct, it will be corrected by the common displacement of the first and the second driving means in order to achieve the desired value. If the x-y-orientation is not correct, it can be corrected by means of different speeds of the driving means. Accordingly, the driving means and the displacement units will be controlled by a control, which processes the results of the actual-target comparison. The paper sheet with corrected positioning is then processed by printer units 211 of the printer 201. Note that the printer 201, device 101, stock of papers sheets 203, feeding device 205, transport device 207, vacuum gripper 209, and the printer units 211 are denoted schematically in FIG. 2 by boxes, wherein the size, shape, and orientation of such items shown in FIG. 2 are not limited to what is shown in FIG. 2.

The following reference numerals are used in the present disclosure to identify the following elements:

101=device according to the present disclosure for the corrective transport of ribbon-shaped substrates;
103=support;
105, 105', 105", 105'"=driving means;
107=large format ribbon-shaped substrate;
107'=middle format ribbon-shaped substrate;
107", 107'"=small format ribbon-shaped substrates;
109=first displacement device;
111=second displacement device;
115, 115', 115", 115'"=counterrollers;
117=laser measuring system;
117'=laser measuring system;
200=printing system;
201=printer;
203=stock of paper sheets;
205=feeding device;
207=transport device;
209=vacuum gripper; and
211=printer units.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

The foregoing description of various forms of the invention has been presented for purposes of illustration and description. It is not intended to be exhaustive or to limit the invention to the precise forms disclosed. Numerous modifications or variations are possible in light of the above teachings. The forms discussed were chosen and described to provide the best illustration of the principles of the invention and its practical application to thereby enable one of ordinary skill in the art to utilize the invention in various forms and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A device for the linear corrective transport of ribbon-shaped substrates, the device comprising:

a receiving device for receiving a ribbon-shaped substrate;

a first drive and a second drive;

a displacement device that displaces the first drive essentially limited to a y-direction relative to the receiving device, wherein the first drive and the second drive transport the ribbon-shaped substrate in an x-direction that is perpendicular to the y-direction, wherein the first drive and the second drive are designed to cooperate in such manner that the first drive can become effective by engaging in a first region of a first edge of the ribbon-shaped substrate and the second drive can become effective by engaging in a second region of a second edge of the ribbon-shaped substrate, wherein the first drive can be controlled in such a way that the first region can be driven at an adjustable first speed;

wherein the second drive can be controlled in such a way that the second region can be driven at an adjustable second speed that is different than the first adjustable speed;

a first drive module comprising the first drive and a third drive, wherein the first drive and the third drive are at a fixed distance D from each other along the y-direction and the third drive can be driven at an adjustable third speed that is different than the first adjustable speed, and wherein the first drive and the third drive are each individually height adjustable in a z-direction that is perpendicular to the x-direction and the y-direction;

a second drive module comprising the second drive and a fourth drive, wherein the second drive and the fourth drive are at a fixed distance D from each other along the y-direction and the fourth drive can be driven at an adjustable fourth speed that is different than the second adjustable speed, and wherein the second drive and the fourth drive are each individually height adjustable in the z-direction;

wherein the first drive module is arranged at the displacement device so that for large format ribbon-shaped substrates in the y-direction a first position of the first drive module can be chosen in such manner that the first drive of the first drive module and the second drive of the second drive module engage in the first and second regions of the first and second edges, respectively, of the large format-shaped substrates, whereas for small format ribbon-shaped substrates in the y-direction, the first drive of the first drive module at the displacement device and the third drive of the first drive module engage in the first and second regions of the first and second edges, respectively, of the small format ribbon-shaped substrates.

2. The device according to claim 1, wherein the first drive is arranged at the displacement device and the second drive is arranged at a second displacement device in such manner that they form a drive pair, which can be displaced in the y-direction while maintaining a distance between the first drive and the second drive.

3. The device according to claim 1, wherein the displacement device is designed such that a distance between the first drive and the second drive with respect to the y-direction is eligibly adjustable.

4. The device according to claim 1, further comprising a second displacement device, wherein the second drive module is arranged at the second displacement device.

5. The device according to claim 4, wherein the displacement device and the second displacement device are designed in such manner that both the first drive module and the second drive module can be displaced synchronously in the y-direction while maintaining a distance between the first drive module and the second drive module in the y-direction.

6. The device according to claim 2, wherein the first drive and the second drive are displaced during the feed of the ribbon-shaped substrate in the x-direction.

7. A printer comprising:

printer units;

a feeding device for ribbon-shaped substrates, wherein the feeding device comprises:

a gripper for gripping a ribbon-shaped substrate from a stack;

a transport device for taking over the ribbon-shaped substrate from the gripper; and a device for corrective transport that receives the ribbon-shaped substrate from the transport device, wherein the device for corrective transport is designed and capable to feed the ribbon-shaped substrate in a correct y-position and a correct x-y-orientation to the printer units provided in the printer, wherein the device for corrective transport comprises:

a receiving device for receiving the ribbon-shaped substrate;

a first drive and a second drive;

a displacement device that displaces the first drive essentially limited to a y-direction relative to the receiving device, wherein the first drive and the second drive transport the ribbon-shaped substrate in an x-direction that is perpendicular to the y direction, wherein the first drive and the second drive are designed to cooperate in such manner that the first drive can become effective by engaging in a first region of a first edge of the ribbon-shaped substrate and the second drive can become effective by engaging in a second region of a second edge of the ribbon-shaped substrate, wherein the first drive can be controlled in such a way that the first region can be driven at an adjustable first speed;

wherein the second drive can be controlled in such a way that the second region can be driven at an adjustable second speed that is different than the first adjustable speed;

a first drive module comprising the first drive and a third drive, wherein the first drive and the third drive are at a fixed distance D from each other along the y-direction and the third drive can be driven at an adjustable third speed that is different than the first adjustable speed, and wherein the first drive and the third drive are each individually height adjustable in a z-direction that is perpendicular to the x-direction and the y-direction;

a second drive module comprising the second drive and a fourth drive, wherein the second drive and the fourth drive are at a fixed distance D from each other along the y-direction and the fourth drive can be driven at an adjustable fourth speed that is different than the second adjustable speed, and wherein the second drive and the fourth drive are each individually height adjustable in the z-direction;

wherein the first drive module is arranged at the displacement device so that for large format ribbon-shaped substrates in the y-direction a first position of the first drive module can be chosen in such manner that the first drive of the first drive module and the second drive of the second drive module engage in the first and second regions of the first and second edges, respectively, of the large format-shaped substrates, whereas for small format ribbon-shaped substrates in the y-direction, the first drive of the first drive module at the displacement device and the third drive of the first drive module engage in the first and second regions of the first and second edges, respectively, of the small format ribbon-shaped substrates.

8. A method for corrective transport of a ribbon-shaped substrate with a device comprising:

a receiving device for receiving a ribbon-shaped substrate;

a first drive and a second drive;

a displacement device that displaces the first drive essentially limited to a y-direction relative to the receiving device, wherein the first drive and the second drive transport the ribbon-shaped substrate in an x-direction that is perpendicular to the y direction, wherein the first drive and the second drive are designed to cooperate in such manner that the first drive can become effective by engaging in a first region of a first edge of the ribbon-shaped substrate and the second drive can become effective by engaging in a second region of a second edge of the ribbon-shaped substrate, wherein the first drive can be controlled in such a way that the first region can be driven at an adjustable first speed;

wherein the second drive can be controlled in such a way that the second region can be driven at an adjustable second speed that is different than the first adjustable speed;

a first drive module comprising the first drive and a third drive, wherein the first drive and the third drive are at a fixed distance D from each other along the y-direction and the third drive can be driven at an adjustable third speed that is different than the first adjustable speed, and wherein the first drive and the third drive are each individually height adjustable in a z-direction that is perpendicular to the x-direction and the y-direction;

a second drive module comprising the second drive and a fourth drive, wherein the second drive and the fourth drive are at a fixed distance D from each other along the y-direction and the fourth drive can be driven at an adjustable fourth speed that is different than the second adjustable speed, and wherein the second drive and the fourth drive are each individually height adjustable in the z-direction;

wherein the first drive module is arranged at the displacement device so that for large format ribbon-shaped substrates a first position of the first drive module can be chosen in such manner that the first drive of the first drive module and the second drive of the second drive module position the large format-shaped substrates, whereas for small format ribbon-shaped substrates, the first drive of the first drive module at the displacement device and the third drive of the first drive module position the small format ribbon-shaped substrates, the device further comprising a second displacement device, wherein the second drive module is arranged at the second displacement device and wherein the displacement device and the second displacement device are designed in such manner that both the first drive module and the second drive module can be displaced synchronously in the y-direction while maintaining a distance between the first drive module and the second drive module in the y-direction, the method comprising:

inserting a front side of the ribbon-shaped substrate into an effective range of the first drive and the second drive;

measuring a y-position and an x-y-orientation of the ribbon-shaped substrate by the first region and carrying out an actual-target comparison;

transporting the ribbon-shaped substrate in the x-direction by driving the first drive and the second drive; and minimizing a deviation of the x-y-orientation from a target value by controlling a difference of the adjustable first speed of the first drive and the adjustable second speed of the second drive;

wherein a deviation of the y-position of the ribbon-shaped substrate from the target value will be minimized by a synchronous equivalent displacement in the y-direction of both the first drive and the second drive which carry the ribbon-shaped substrate.

9. The method according to claim 8, wherein before inserting the ribbon-shaped substrate into the effective range of the first drive and the second drive, the distance between the first drive and the second drive in the y-direction is adjusted in such manner that, after inserting the ribbon-shaped substrate into the effective range of the first drive and the second drive, the first drive has an effect in the first region of the ribbon-shaped substrate and the second drive has an effect in the second region of the ribbon-shaped substrate.

* * * * *